US006336764B1

(12) United States Patent
Liu

(10) Patent No.: US 6,336,764 B1
(45) Date of Patent: Jan. 8, 2002

(54) ADJUSTABLE WATER-GUIDING ROD FOR A CLEANING BRUSH

(76) Inventor: Te-Ching Liu, P.O. Box 96-405, Taipei 106 (TW)

( * ) Notice: Subject to any disclaimer, the term of this patent is extended or adjusted under 35 U.S.C. 154(b) by 46 days.

(21) Appl. No.: 09/663,371

(22) Filed: Sep. 9, 2000

(51) Int. Cl.[7] ..... A46B 11/06

(52) U.S. Cl. ..... 401/289; 285/185; 15/144.1; 15/172; 401/282; 401/268

(58) Field of Search ..... 401/289, 282, 401/268, 290, 203, 42; 285/185, 184, 262, 191; 15/144.1, 172

(56) References Cited

U.S. PATENT DOCUMENTS

| | | | | | |
|---|---|---|---|---|---|
| 359,394 | A | * | 3/1887 | Jones et al. | 285/66 |
| 451,300 | A | * | 4/1891 | Drew | 285/47 |
| 586,841 | A | * | 7/1897 | Drew | 285/185 |
| 1,765,693 | A | * | 6/1930 | Muend | 285/181 |
| 2,185,164 | A | * | 12/1939 | Weinreb | 24/523 |
| 4,535,938 | A | * | 8/1985 | Lindabury, Sr. | 239/269 |
| 4,639,018 | A | * | 1/1987 | Froelich et al. | 285/184 |
| 4,717,180 | A | * | 1/1988 | Roman | 285/175 |
| 4,720,883 | A | * | 1/1988 | Sanchez | 15/4 |

* cited by examiner

*Primary Examiner*—Gregory L. Huson
*Assistant Examiner*—Huyen Le

(57) ABSTRACT

An adjustable water-guiding rod for a cleaning brush comprises a rotary joint furnished between a water-input rod and a water-output rod. The rotary joint includes two disks, each of which is mounted on one end of the water-input rod and the water-output rod respectively. The disks are furnished with ring-shaped water passages respectively in communication with each other. The inner surface and the outer surface of the ring-shaped water passage are mounted with seal rings. One of the two disks is furnished with clutch teeth and a bolt at the center thereof. The other disk is mounted with a positioning disk and a spring is provided therebetween. The positioning disk has clutch teeth for engaging with the clutch teeth of one of the disks. A rotary disk having a thread center hole is mounted on the outer surface of the positioning disk to couple with the bolt for joining the two disks and the positioning disk together. The two disks are set at a position by the clutch teeth. After the rotary disk is loosened, the spring will push the positioning disk out of the engagement of the clutch teeth gradually. The two disks are still maintained in the original tension to let the water-output rod be adjusted at a desired angle without water leakage.

4 Claims, 5 Drawing Sheets

ADJUSTABLE WATER-GUIDING ROD FOR A CLEANING BRUSH

BACKGROUND OF THE INVENTION

1. Field of the Invention

This invention relates to a cleaning brush, and particularly to an adjustable water-guiding rod for a cleaning brush.

2. Description of the Prior Art

A conventional cleaning brush usually includes a separate handle to connect with a water hose; the other end of the hose is connected with a faucet so as to clean and brush something.

Another conventional cleaning brush includes an elongate rod mounted with a brush, and the other end of the rod is connected with a hose so as to direct water to the brush; the elongate rod can reach a higher or farther spot to conduct cleaning and brushing.

By using a conventional cleaning brush, it is rather difficult to brush a higher flat surface or an oblique flat surface because of the brush rod being a straight rod; in that case, the person doing brush work has to use a ladder to do it.

Another conventional cleaning brush has a joint in the water-guiding rod; one end of the water-guiding rod is mounted with a connector, of which one side is furnished with a cylinder to be connected with a connector mounted on another rod; the outer end of the cylinder is mounted with a threaded part. The two connectors can be communicated through a hole in the cylinder; however, such type of connector is liable to become loose unintentionally.

SUMMARY OF THE INVENTION

The prime object of the present invention is to provide an adjustable water-guiding rod for a cleaning brush, in which a rotary joint is mounted between a water-input rod and a water-output rod of the water-guiding rod; the rotary joint includes two disks furnished on both ends of the water-input rod and the water-output rod respectively; both surfaces of the two disks are furnished with ring-shaped water passages respectively, being in communication with each other; both the inner and outer surfaces of the ring-shaped water passages are furnished with ring-shaped grooves for receiving seal rings respectively. The two disks are connected together by means of a bolt in the center thereof; the outer edges of the disks are furnished with opposite clutch teeth so as to have them engaged together at a given position. After the two disks are assembled and tightened together by means of the rotary disk, the rotary joint between the water-input rod and the water-output rod would not become loose unintentionally so as to facilitate water to flow through.

Another object of the present invention is to provide an adjustable water-guide rod for a cleaning brush, in which the outer edge of one of the two disks of the water-input rod and the water-output rod is furnished with clutch teeth; the inner edge of the clutch teeth is furnished with a ring-shaped surface to be engaged with a round flange of the second disk. A positioning disk is mounted over the second disk; the lower edge of the positioning disk is furnished with clutch teeth; after the two disks and the positioning disk are assembled together, the water-input rod and the water-output rod will be engaged with each other by means of the clutch teeth to prevent the two rods from loosening and slipping.

Still another object of the present invention is to provide an adjustable water-guide rod for a cleaning brush, in which the inside of the positioning disk mounted over the disk of the water-output rod has a cylindrical space for receiving the second disk; one side of the positioning disk has a cut-out for receiving the water-output rod so as to have the positioning disk and the water-output rod fastened together. After the second disk, the positioning disk and the first disk of the water-input disk are assembled together, the clutch teeth of the positioning disk will engage with the ring-shaped surface of the first disk to provide a positioning function.

A further object of the present invention is to provide an adjustable water-guiding rod for a cleaning brush, in which the center of the first disk has a bolt to pass through a cylindrical hole of the second disk, and a round hole of the positioning disk; the end of the bolt is screwed together with a thread portion of the rotary disk so as to have the rotary joint assembled together. The outer side of the rotary disk is-furnished with a cross-shaped knob to facilitate holding and turning by hand upon the rotary joint being assembled.

A still further object of the present invention is to provide an adjustable water-guiding rod for a cleaning brush, in which the center of the water-input rod has a water-input passage; the first disk of the water-input rod has a ring-shaped water passage to communicate with the water-input passage of the water-input rod; the center of the water-output rod has a water-output passage; the center of the second disk of the water-output rod also has a ring-shaped water passage to communicate with the water-output passage of the water-output rod. After the two disks of the water-input rod and the water-output rod are assembled together, the two ring-shaped water passages in the two disks will be in communication with each other for receiving water from the water-input passage of the water-input rod, and the water will flow through the ring-shaped water passage of the rotary joint and the water-output rod, and finally to the cleaning brush.

Yet another object of the present invention is to provide an adjustable water-guiding rod for a cleaning brush, in which the inner and outer surfaces of the two ring-shaped water passages of the two disks between the two water rods are furnished with two ring-shaped grooves having different diameters respectively; the two ring-shaped grooves are used for receiving two seal rings respectively. After the two disks and the rotary disk are assembled together with the bolt, the seal rings in the inner and outer surfaces of the ring-shaped water passage will prevent water from leaking out of the contact surfaces of the rotary joint.

Yet still another object of the present invention is to provide an adjustable water-guiding rod for a cleaning brush, in which the two disks of the water-input rod and the water-output rod have two ring-shaped water passages respectively to be in communication with each other; the inner and outer seal rings can prevent the rotary joint from leak of water.

Yet a further object of the present invention is to provide an adjustable water-guiding rod for a cleaning brush, in which the outer edge of one of the two disks of the water rods is mounted with a positioning disk; a spring is mounted between the positioning disk and the disk; the positioning disk has ring-shaped clutch teeth to be engaged with the clutch teeth of the other disk. When the rotary disk is loosened, the two disks are still in close contact with each other as a result of the spring; then, the positioning disk over the disk of the water-output rod will disengage from the disk of the water-input rod as a result of being pushed with the spring so as to facilitate the two rods to be adjusted at an angle desired. During the two rods being adjusted at an angle, the two disks are still maintained in a close contact tension so as to prevent from leak of water.

DETAILED DESCRIPTION OF THE PREFERRED EMBODIMENT

Figure 1:
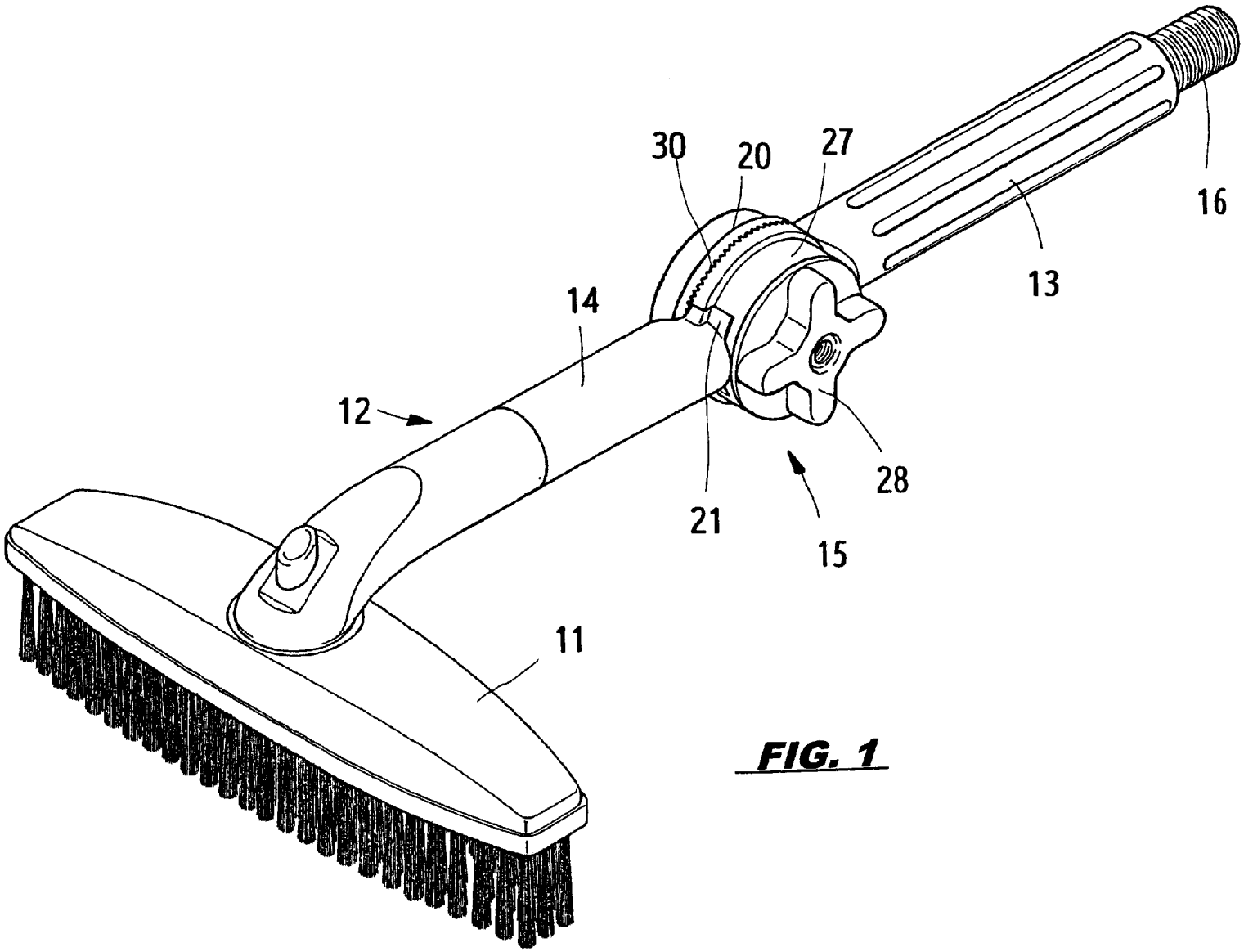
FIG. 1 is a perspective view of a cleaning brush according to the present invention.
Figure 2:
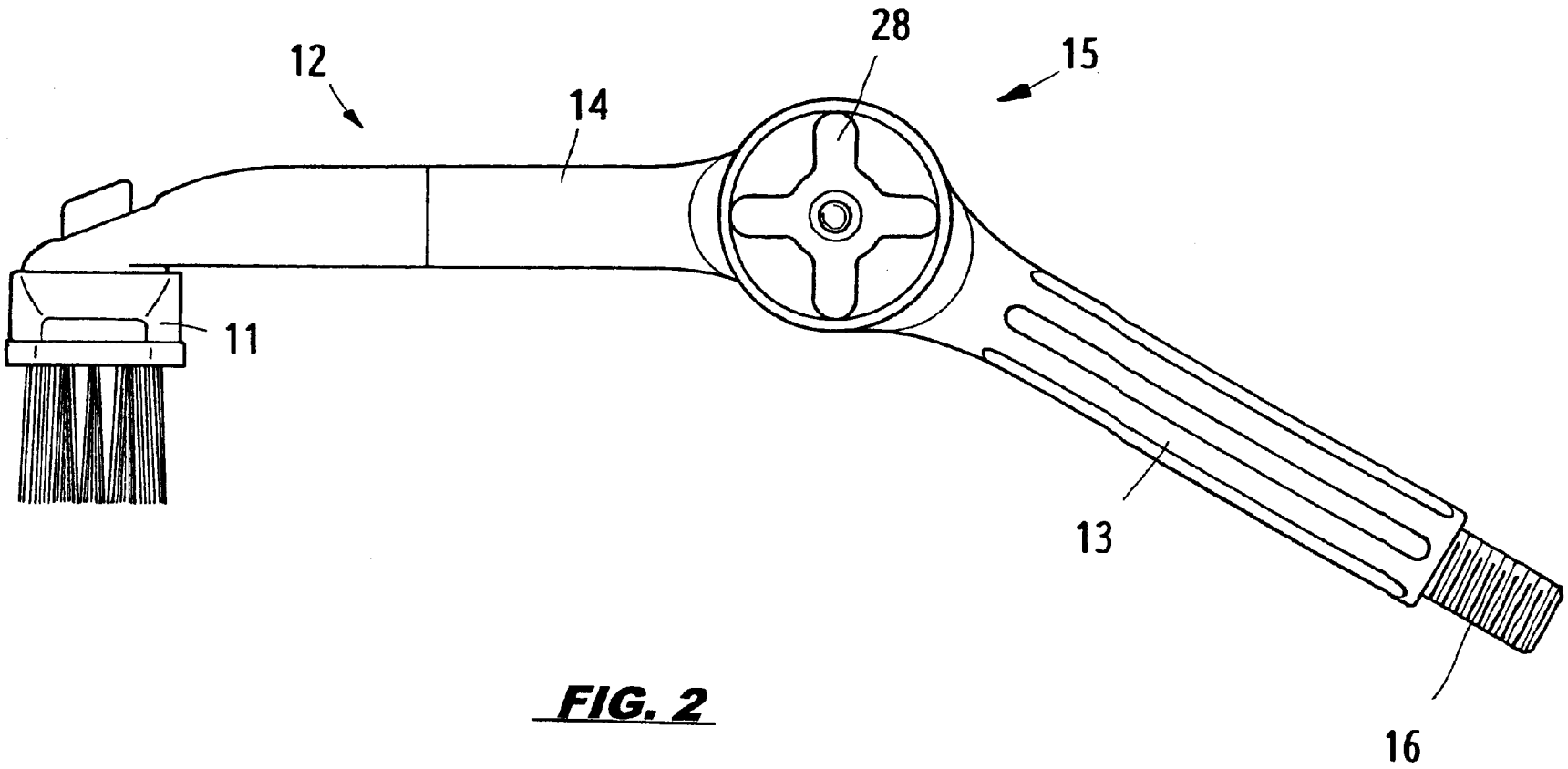
FIG. 2 is a plan view of the present invention, showing the joint of the water-guiding rod being rotated at a given angle.
Figure 3:
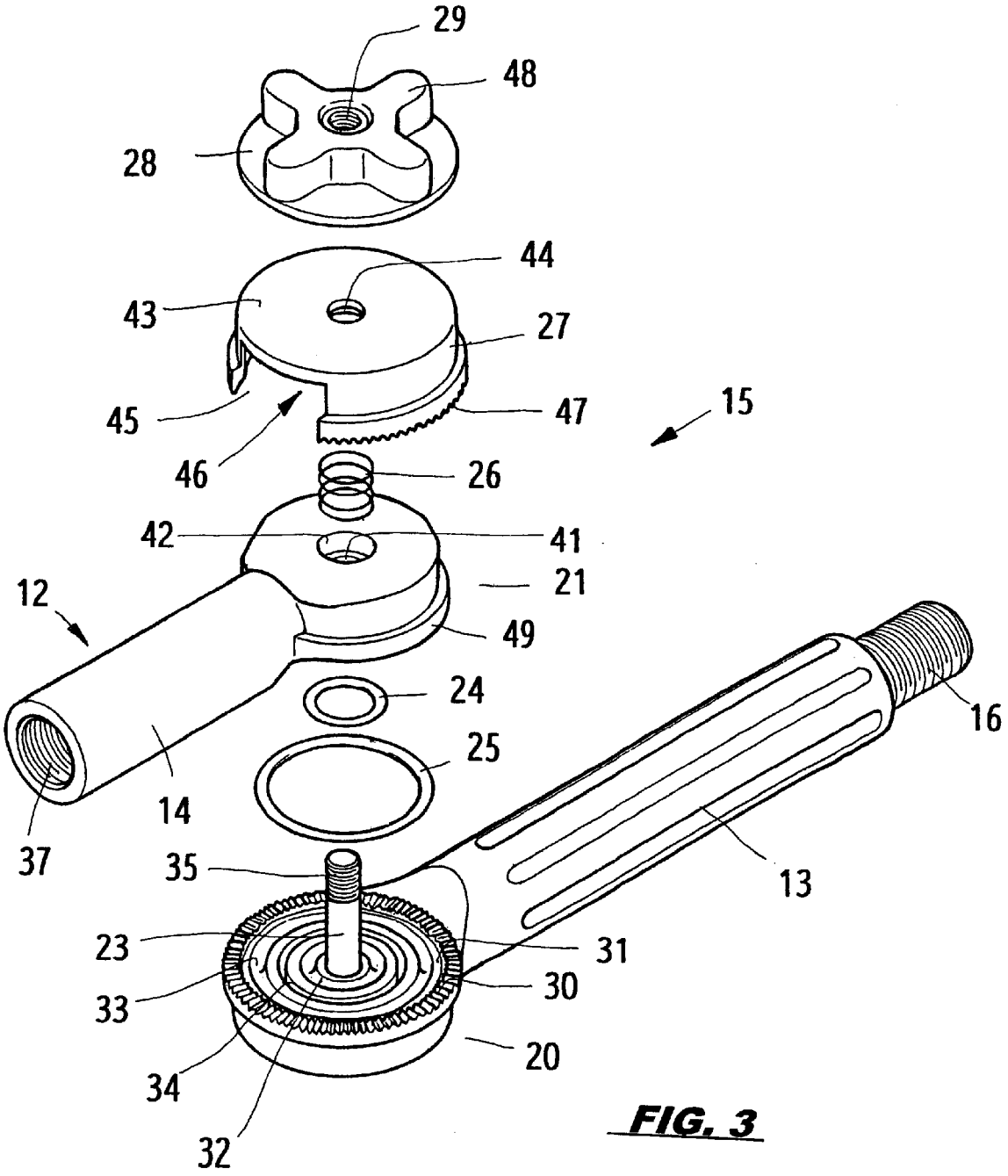
FIG. 3 is a disassembled view of the present invention.

This invention relates to an adjustable water-guiding rod for a cleaning brush; as shown in FIGS. 1 to 4, a rotary joint 15 is furnished between the water-input rod 13 and the water-output rod 14 of the water-guiding rod 12 in the brush 11. Between the connection ends of the water input rod 13 and the water-output rod 14, there are two disks 20 and 21 contacted together; between the contact surfaces of the two disks, there are two ring-shaped water passages 34 and 40 in communication with each other, and two seal rings 24 and 25; the two disks are assembled together by means of a bolt 23 in the center thereof. The outer edges of the two disks are furnished with clutch teeth 30 and 47 respectively, which are engaged together. The water-input rod 13 and the water-output rod 14 are connected together by means of two disks 20 and 21, which are assembled together; after the rotary disk 28 being turned tight upon an angle between the water-input rod 13 and the water-output rod 14 being set, the rotary joint between the water-input rod 13 and the water-output rod 14 will not become loose unintentionally.

The water-input rod 13 of the water-guiding rod 12 has a water-input passage 36 in the center thereof; the other end of the water-input rod 13 is furnished with a disk 20, of which the center has a bolt 23 upon being molded; the bolt 23 is to be assembled with the parts of a rotary joint 15. The inner surface of the disk 20 is furnished with a ring-shaped water passage 34 in communication with the water-input passage 36 in the center of the rod. When water flows into the water-input passage 36, the water will soon flow through the ring-shaped water passage 34 of the disk 20 and to a ring-shaped water passage 40 of another disk 21 on the water-output rod 14 and the water-output passage 37, and then to the cleaning brush 11. The inner surface of the disk 20 of the water-input rod 13 has a ring-shaped water passage 34; the inner and outer ring surfaces thereof are mounted with seal rings 24 and 25 respectively so as to prevent a gap between the two disks 20 and 21 from leak after the disk 21 of the water-output rod 14 being mounted in place.

The outer edge of the disk 20 of the water-input rod 13 is furnished with clutch teeth 30 which are slightly higher than the inner surface thereof; the clutch teeth 30 are substantially small teeth; the inner edge of the clutch teeth 30 has a ring-shaped surface 31. After the disk 21 of the water-output rod 14 is mounted in place, the ring-shaped surface 31 will be mated with the round flange 49 of the second disk 21 so as to have the two disks 20 and 21 assembled together to provide a circular guide surface.

The center of the water-output rod 14 has a water-output passage 37, of which one end is furnished with inner threads so as to facilitate the rod of cleaning brush 11 to connect; the other end of the rod has a disk 21, of which the center has a cylindrical hole 41; the outer end of the cylindrical hole 41 has a cylindrical groove 42 for receiving the bolt 23 of the disk 20 to form into a center shaft. A spring 26 is to be mounted in the cylindrical groove 42 to provide an outward pushing force for the positioning disk 27; the inner surface of the disk 21 has a ring-shaped water disk 40 to be in communication with the water-output passage 37 of the rod so as to facilitate water to flow through the ring-shaped water passage 34, the ring-shaped water passage 40 of the disk 21 and to flow to the cleaning brush 11 through the water-output passage 37 of the water-output rod 14. The inner surface of the disk 21 is furnished with a ring-shaped water passage 40; the inner and outer surfaces of the water passage 40 are furnished with two concentric ring-shaped grooves 38 and 39, which are corresponding and opposite to the ring-shaped grooves 32 and 33 05 respectively of the disk 20 in order to mount two seal rings 24 and 25 respectively for preventing the gap between the two disks 20 and 21 from leaking.

After the disk 21 of the water-output rod 14 is mounted over the disk 20 of the water-input rod 13, the round flange 49 thereof will be fitted into the ring-shaped surface 31 inside the clutch teeth 30 so as to step up the positioning strength between the two disks 21 and 20. A positioning disk 27 is mounted over the disk 21; the inner center of the disk 27 has a cylindrical space 46, and one side thereof has a cut-out 45, which is slightly wider than the diameter of the water-output rod 14. After the positioning disk 27 is mounted over the disk 21 of the water-output rod 14, an opening under the disk 27 is furnished without hindering the rod; the cylindrical space 46 of the positioning disk 27 is closely in contact with the outer surface of the disk 21.

After the positioning disk 27 is mounted over the disk 21, the round hole 44 thereof will be mounted around the bolt 23 on the disk 20. The outer edge of the positioning disk 27 is furnished with clutch teeth 47, which are to be mated with the clutch teeth 30 of the disk 20 of the water-input rod 13. After the positioning disk 27 is mounted in place, the clutch teeth 47 of the positioning disk 27 and the clutch teeth 30 of the disk 20 will provide a clutch function.

After the positioning disk 27 is mounted over the disk 21 of the water-output rod 14 and the disk 20 of the water-input rod 13, the bolt 23 on the center of the disk 20 will penetrate through the cylindrical hole 41 of the disk 21, the round hole 44 of the positioning disk 27 and the rotary disk 28. The outer surface of the rotary disk 28 is furnished with a cross-shaped knob 48, of which the center has a threaded hole 29 to be engaged with the thread portion 35 of the bolt 23. The inner surface of the rotary disk 28 is furnished with slightly salient rib strips 50, which can provide a uniform pressure against the outer surface of the positioning disk 27 upon the rotary disk 28 being screwed tightly in place so as to have the clutch teeth 47 of the positioning disk 27 and the clutch teeth 30 of the disk 20 positioned firmly, and to prevent the parts of the water-input rod 13 and the water-output rod 14 from being loosened.

In order to prevent the seal rings 14 and 15 from fatigue failure under long time pressure between the disk 20 and the disk 21, a positioning disk 27 is mounted over the disk 21; the outer flat surface 43 of the positioning disk 27 will be in contact with the rotary disk 28; after the rotary disk 28 is screwed tightly, the pressure thereof will fall between the clutch teeth 47 and the clutch teeth 30 of the disk 20 without having over-pressure added to the disk 21.

The center of the disk 21 has a cylindrical hole 41 and a cylindrical groove 42; a spring 26 is to be mounted in the cylindrical groove 42; the positioning disk 27 is to be in contact with the spring 26 upon the disk being mounted over the disk 21. After the rotary disk 28 is mounted to the thread portion 35 of the bolt 23, a pushing force will be applied to push the positioning disk 27 towards the disk 21 until the clutch teeth 47 of the positioning disk 27 being in contact and engagement with the clutch teeth 30 of the disk 20.

Figure 4:
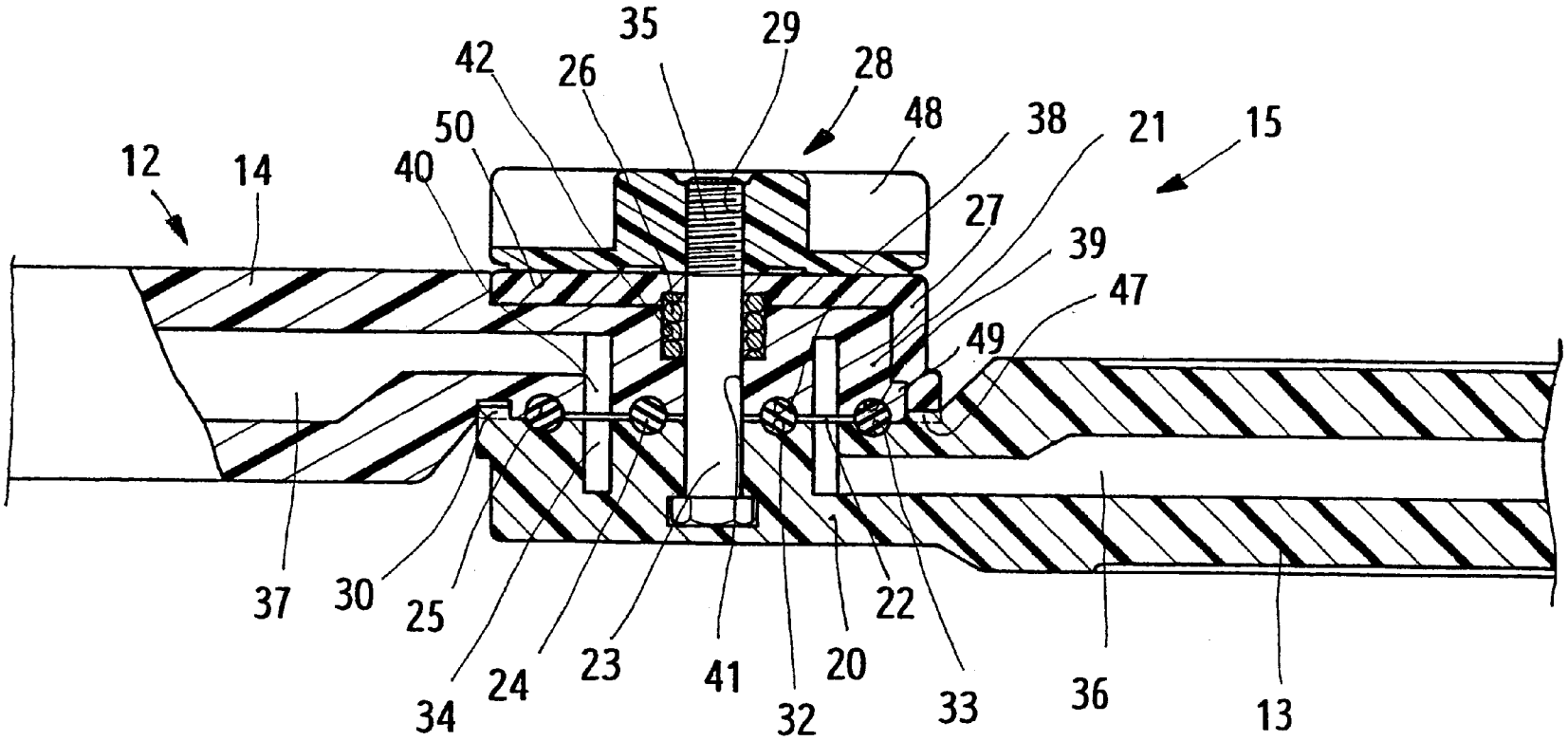
FIG. 4 is a sectional view of the present invention.
Figure 5:
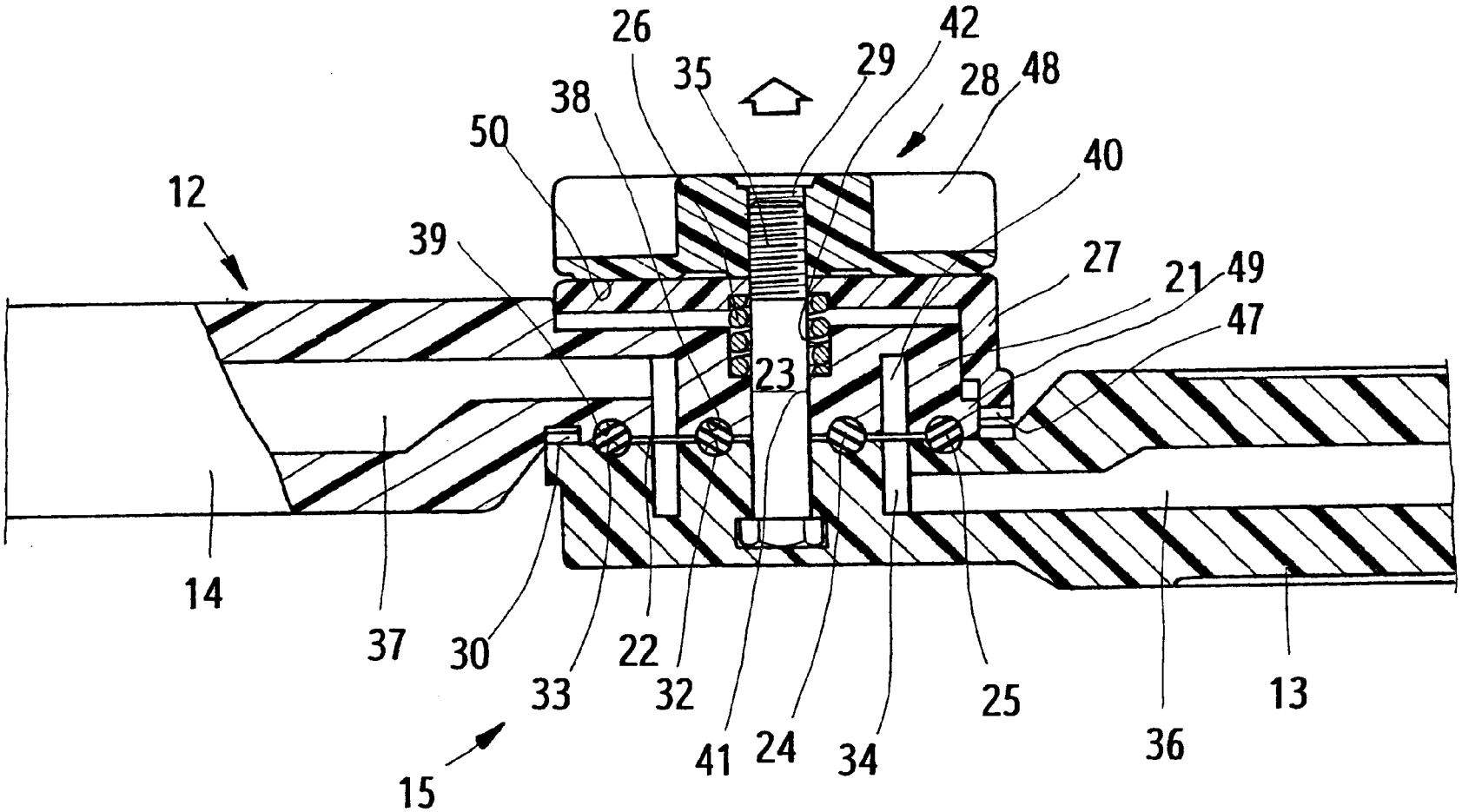
FIG. 5 is a sectional view of the present invention, showing the rotary disk being released to adjust the rod at a given angle.

The spring 26 in the cylindrical groove 42 of the disk 21 is kept in the cylindrical groove 42 by means of the rotary disk 28 as shown in FIG. 4, i.e., the rotary disk 28 will push the positioning disk 27 to cause the clutch teeth 47 thereof to engage with the clutch teeth 30 of the disk 20 so as to control the rotation position between the positioning disk 27 and the disk 20. The cut-out 45 of the positioning disk 27 is mounted over the water-output rod 14 so as to control the swinging of the water-output rod 14. When the angle between the water-input rod 13 and the water-output rod 14 has to be adjusted, the cross-shaped knob 48 of the rotary disk 28 of the rotary joint 15 can be rotated by hand.

When the rotary disk 28 is loosened as shown in FIG. 4, the spring 26 in the cylindrical groove 42 of the disk 21 will push the clutch teeth 47 of the positioning disk 27 to disengage with the clutch teeth 30 of the disk 20; the disk 21 pushed by the spring 26 still maintains under a pressure; in that case, the seal rings 24 and 25 between the two disks 20 and 21 are still under a given pressure without having any leak upon the water-output rod 14 being turned at an angle.

As soon as the positioning disk 27 is disengaged from the clutch teeth 30 of the disk 20 as a result of the pushing force of spring 26, the disk 21 of the water-output rod 14 under the positioning disk 27 can be turned at an angle; the inner surface of the disk 21 pushed with the spring 26 still maintains under the original tension of contact, i.e., having no leak upon the disk 21 being turned.

After the water-input rod 13 and the water-output rod 14 are turned at an angle desired, turn the rotary disk 28 tight so as to have the clutch teeth 47 and the clutch teeth 30 of the disk 20 engaged together again as a result of the positioning disk 27 being pressed; in that case, the angle between the water-input rod 13 and the water-output rod 14 can not be adjusted.

What is claimed is:

1. An adjustable water-guiding rod for a cleaning brush comprising:

a water-input rod including a water-input passage in center thereof; one end of said rod having a disk furnished with a ring-shaped water passage in communication with a said water-input passage; both inner and outer surfaces of said ring-shaped water passage furnished with ring-shaped grooves for receiving seal rings respectively; the center of said disk furnished with a bolt, and the outer edge of said disk furnished clutch teeth; a surface of said disk assembled together with a water-output rod;

said bolt molded together with said water-input rod disk; the outer end of said bolt furnished with a thread portion for mounting a rotary joint thereon;

said water-output rod having a water-output passage in center thereof; one end thereof having a disk furnished with a ring-shaped water passage in communication with a water-output passage; both inner and outer surfaces of said ring-shaped water passage of said disk furnished with ring-shaped grooves respectively for receiving seal rings; the center of said disk furnished with a cylindrical hole for receiving said bolt, and the outer edge of said disk mounted with a positioning disk;

two sealing rings having different diameters mounted between said disks of said water-input rod and said water-output rod respectively a spring mounted in a cylindrical groove of said disk of said water-output rod, and one end of said spring pushing against the inner surface of said positioning disk;

said positioning disk mounted over said disk of said water-output rod by means of a cylindrical space which being similar to outer shape of said disk; one side of said positioning disk furnished with a cut-out for receiving said water-output rod; the center of said positioning disk having a round hole for receiving said bolt; the outer edge of said positioning disk furnished with ring-shaped clutch teeth engaged with said clutch teeth of said disk of said water-input rod; and a rotary disk having a cross-shaped knob on the outer surface thereof, and the center thereof furnished with a threaded hole; the inner surface thereof furnished with slightly salient rib strips; said threaded hole engaged with said thread portion of said bolt so as to control tension between said water-input rod and said water-output rod.

2. An adjustable water-guiding rod for a cleaning brush as claimed in claim 1, wherein the outer edge of said disk on one end of said water-input rod is furnished with said clutch teeth to be engaged with said clutch teeth on the outer edge of said positioning disk over said disk of said water-output rod.

3. An adjustable water-guiding rod for a cleaning brush as claimed in claim 1, wherein the outer edge of said disk of said water-input rod is furnished with ring-shaped clutch teeth slightly higher than inner surface thereof; a said ring-shaped surface furnished within said clutch teeth so as to receive a round flange of disk of said water-output rod; after said ring-shaped surface and said round flange being engaged together, a circular guide surface being formed for said two disks.

4. An adjustable water-guiding rod for a cleaning brush comprising:

a water-input rod having a water-input passage in center thereof, and one end of said rod furnished with a disk, which has a ring-shaped water passage in communication with said water-input passage; the inner and outer surfaces of said ring-shaped water passage furnished with ring-shaped grooves for receiving seal rings respectively, and the center of said disk having a bolt;

a said bolt furnished integrally on said disk upon molding; the outer end of said bolt having a thread portion for mounting a rotary joint;

a water-output rod having a water-output passage in the center thereof, and one end of said rod furnished with a disk, which has a ring-shaped water passage in communication with said water-output passage; the inner and outer surfaces of said ring-shaped water passage furnished with ring-shaped grooves for receiving seal rings respectively; the center of said disk furnished with a cylindrical hole for receiving said bolt;

a rotary disk having a threaded hole in center thereof to be mounted on the thread portion of said bolt; and which characterized that the outer edge of said water-input rod disk being furnished with clutch teeth, of which the inner edge having a ring-shaped groove for receiving a round flange of said disk of said water-output rod; said two disks able to be assembled together by means of said ring-shaped surface and said round flange; the center of said disk of said water-output rod having a cylindrical groove for receiving a spring to be pressed in said cylindrical groove by means of said rotary disk; said disk of said water-output rod mounted with a positioning disk which has clutch teeth on the outer edge thereof; said clutch teeth to be engaged with said clutch teeth of disk of said water-input rod; after said rotary disk being turned tight, said clutch teeth of said positioning disk and said clutch teeth of said disk able to en gage together at a given position so as to control a turning angle between said positioning disk and said disk; after said rotary disk being loosened, said spring in said cylindrical groove able to push said clutch teeth of said positioning disk to disengage from said clutch teeth of said disk gradually, but said two disks being maintained under original tension so as to facilitate said water-output rod to be adjusted at an angle without causing leak of water.

* * * * *